US010051899B2

(12) United States Patent
Campbell

(10) Patent No.: US 10,051,899 B2
(45) Date of Patent: Aug. 21, 2018

(54) SPLIT LAP APRON WITH MAGNETIC FASTENING AND FITTING SYSTEM

(71) Applicant: Travis Campbell, Colona, IL (US)

(72) Inventor: Travis Campbell, Colona, IL (US)

( * ) Notice: Subject to any disclaimer, the term of this patent is extended or adjusted under 35 U.S.C. 154(b) by 469 days.

(21) Appl. No.: 14/863,815

(22) Filed: Sep. 24, 2015

(65) Prior Publication Data

US 2016/0088885 A1 Mar. 31, 2016

Related U.S. Application Data

(60) Provisional application No. 62/056,031, filed on Sep. 26, 2014.

(51) Int. Cl.

| | |
|---|---|
| ***A41D 13/04*** | (2006.01) |
| ***A41D 15/00*** | (2006.01) |
| ***A41F 1/00*** | (2006.01) |

(52) U.S. Cl.

CPC ..... *A41D 13/04* (2013.01); *A41D 15/002* (2013.01); *A41F 1/002* (2013.01)

(58) Field of Classification Search

CPC ..... A41D 13/04; A41D 15/00; A41D 15/002; A41D 15/02; A41D 2200/10; A41F 1/002; A41F 5/00; A41F 1/00; A41F 9/00; A41F 9/02; A41F 9/025; A41F 17/00; A41F 19/00; A41B 1/06; A44D 2203/00

USPC .... 2/48, 52, 51, 70, 78.4, 107, 112, 79, 221, 2/237; 24/303

See application file for complete search history.

(56) References Cited

U.S. PATENT DOCUMENTS

| | | | | | |
|---|---|---|---|---|---|
| 712,908 | A | * | 11/1902 | Clark | A41D 13/04 2/51 |
| 914,296 | A | * | 3/1909 | Melasky | A41D 1/06 2/227 |
| 1,451,095 | A | * | 4/1923 | Greene | A41D 13/04 2/51 |
| 1,570,917 | A | * | 1/1926 | Orent | A41D 5/00 2/70 |
| 1,611,420 | A | * | 12/1926 | Cuddy | A41D 13/02 2/70 |
| 2,129,486 | A | * | 9/1938 | Berman | A41D 13/046 2/51 |
| 2,389,298 | A | * | 11/1945 | Ellis | A41F 1/002 101/389.1 |

(Continued)

FOREIGN PATENT DOCUMENTS

| | | | | | |
|---|---|---|---|---|---|
| CA | 2353716 | A1 | * | 6/2000 | A41F 1/002 |
| CH | 706946 | A2 | * | 3/2014 | A45D 44/08 |

(Continued)

OTHER PUBLICATIONS

English language machine translation of DE 202011003425 (doc. pub. Aug. 2011), 7 pages.*

*Primary Examiner* — Amy Vanatta
(74) *Attorney, Agent, or Firm* — Harpman & Harpman

(57) ABSTRACT

A two piece magnetically secured apron that provides a split upper and lower body portions utilizing an upper body portion retainment by magnets enabled neck engagement straps and bottom edge fixed magnets. The lower portion has magnetic adjustable waistband straps for overlapping magnetic engagement allowing the straps to be slidably adjusted in relation to one another. Independent magnetic leg straps adjustably retain the apron leg portions completing the assembly of the invention.

2 Claims, 7 Drawing Sheets

(56) References Cited

U.S. PATENT DOCUMENTS

| | | | | | |
|---|---|---|---|---|---|
| 2,648,845 | A * | 8/1953 | Berman | A41B 13/10 | 2/48 |
| 4,255,837 | A * | 3/1981 | Holtz | B42F 11/04 | 24/303 |
| 5,107,545 | A * | 4/1992 | Potter | A41D 13/0012 | 2/46 |
| 5,682,653 | A * | 11/1997 | Berglof | G09F 1/10 | 224/183 |
| 5,950,239 | A | 9/1999 | Lopez | | |
| 6,185,741 | B1 * | 2/2001 | Kehoe | A41D 7/00 | 2/67 |
| 6,412,116 | B1 * | 7/2002 | Clark | A41F 1/002 | 2/129 |
| 7,404,215 | B2 * | 7/2008 | Allen | A41D 27/12 | 2/231 |
| 8,516,621 | B2 | 8/2013 | Woolery | | |
| 8,584,262 | B2 | 11/2013 | Ekelund et al. | | |
| 9,752,262 | B1 * | 9/2017 | Martelli | D05B 39/005 | |
| 2008/0092263 | A1 * | 4/2008 | Good | A41B 13/10 | 2/49.1 |
| 2010/0306895 | A1 * | 12/2010 | Tagatz | A45D 44/08 | 2/50 |
| 2015/0173427 | A1 * | 6/2015 | Sawyer | A41D 7/00 | 2/67 |
| 2015/0216239 | A1 * | 8/2015 | Acevedo-Morales | A41B 13/10 | 2/49.1 |

FOREIGN PATENT DOCUMENTS

| | | | | |
|---|---|---|---|---|
| DE | 202011003425 | U1 * | 8/2011 | A41D 13/04 |
| DE | 202014006719 | U1 * | 10/2014 | A41D 13/04 |
| DE | 202015104372 | U1 * | 11/2015 | A41F 1/002 |

* cited by examiner

SPLIT LAP APRON WITH MAGNETIC FASTENING AND FITTING SYSTEM

This application claims the benefit of U.S. Provisional Application No. 62/056,031, filed on Sep. 26, 2014.

BACKGROUND OF THE INVENTION

1. Technical Field

This invention relates to protective aprons used to protect a wearer's clothing by providing a flexible barrier that is temporarily secured over the user's clothing, typically by straps and ties extending from the apron.

2. Description of Prior Art

Prior art devices of this type have been directed to cloth and specialized fabric material aprons that are positioned over the user's clothing and typically secured by multiple straps tying them in place. Examples of positioning and retaining by magnets can be seen in U.S. Pat. Nos. 8,584,262; 8,516,621; 5,950,239 and International Patent WO2007/088366.

U.S. Pat. No. 8,584,262 discloses a bib that has multiple retainment magnets placed to selectively the bib in position.

U.S. Pat. No. 8,516,621 claims magnetic work clothes having magnets on the work surface so as to hold miscellaneous metallic parts and tools randomly positioned thereon.

U.S. Pat. No. 5,950,239 is directed to magnetic therapy treatment in clothing. A plurality of magnets are placed in the clothing in aligned orientation to assist in the healing of the human body.

International Patent WO 207/088366 illustrates an apron having multiple pleated folds with magnetic means to hold the fold configuration in proper orientation.

SUMMARY OF THE INVENTION

A two part apron assembly having multiple fixed and moveable securement and retainment magnets integrated therein and on, with corresponding bands and straps. Permanent magnetic sets are slidably positioned within opposing overlapping adjustable waist retainment straps to provide an adjustable retainment thereof, which in combination of fixed magnets on multiple retainment straps secures the multiple part apron assembly on to a user.

DESCRIPTION OF THE PREFERRED EMBODIMENT

Figure 1:
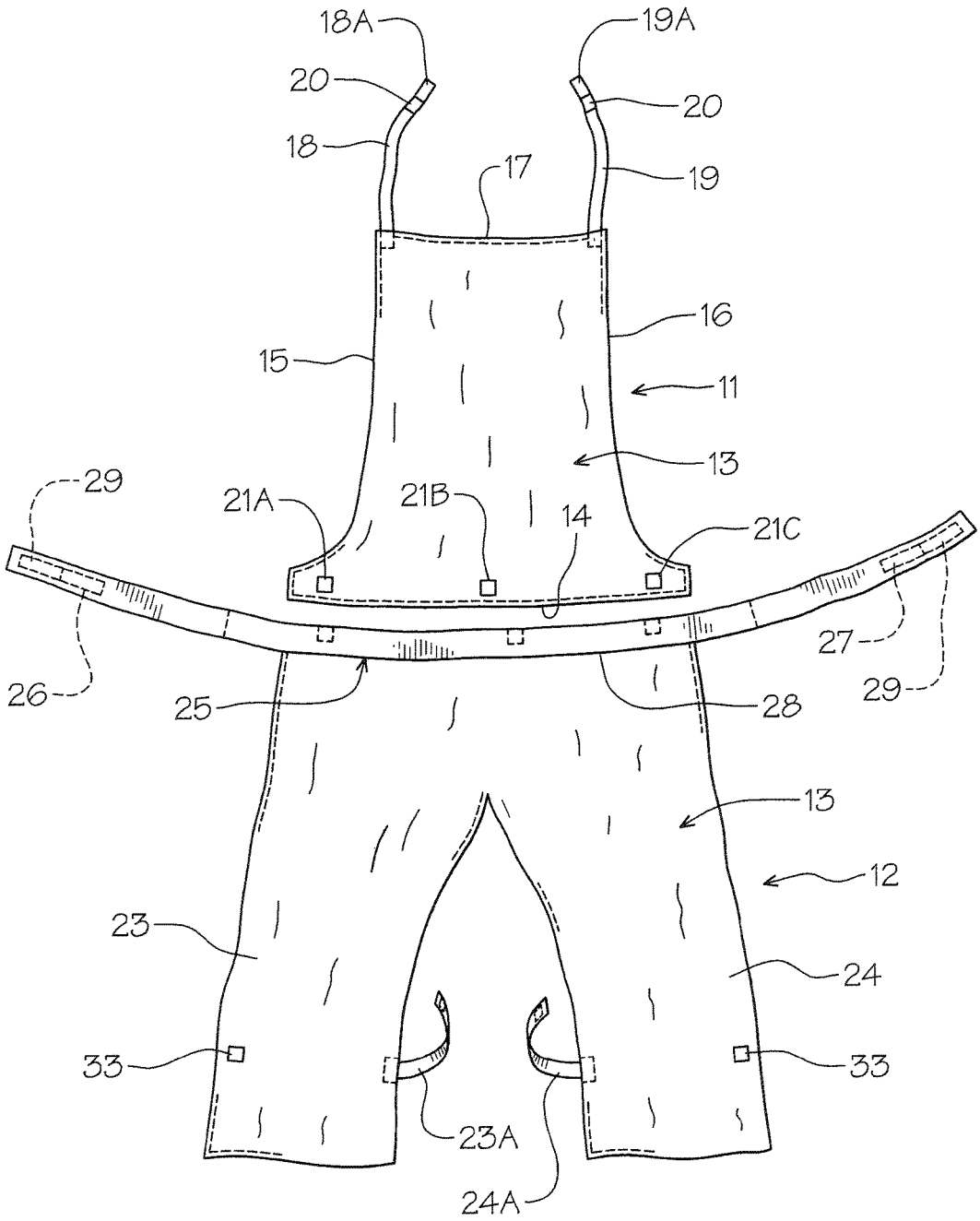
FIG. 1 is a front elevation view of the apron assembly illustrating the retaining and adjustment magnets enabling straps of the invention.

Referring to FIG. 1 of the drawings, a two part magnetically secured apron assembly 10 can be seen having an upper torso portion 11 and a lower torso portion 12. The upper torso portion 11 is of a general of thin flat flexible body material 13 having a bottom edge 14, generally parallel opposing side edges 15 and 16, and an oppositely disposed top edged portion 17.

A pair of neck of engagement and retaining straps 18 and 19 extend from, in this example, the respective corner intersections of the top edge 17 and side edges 15 and 16. Each of the retainment straps 18 and 19 have an attached magnet 20 secured on the respective free ends 18A and 19A for registering engagement with one another as will be understood by those skilled in the art.

The bottom edge 14 of the upper torso portion 11 has a plurality of longitudinally spaced fixed permanent magnets 21A, 21B, and 21C secured thereto providing for edge retainment with the lower torso portion 12.

Figure 5:
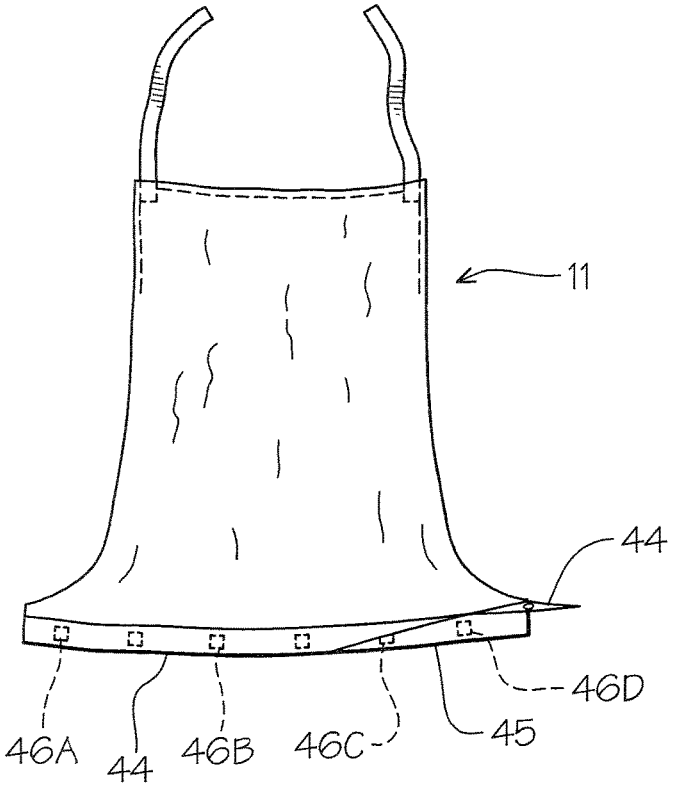
FIG. 5 is a front elevational view of an alternate apron assembly for selective magnet clamp to a low portion.
Figure 6:
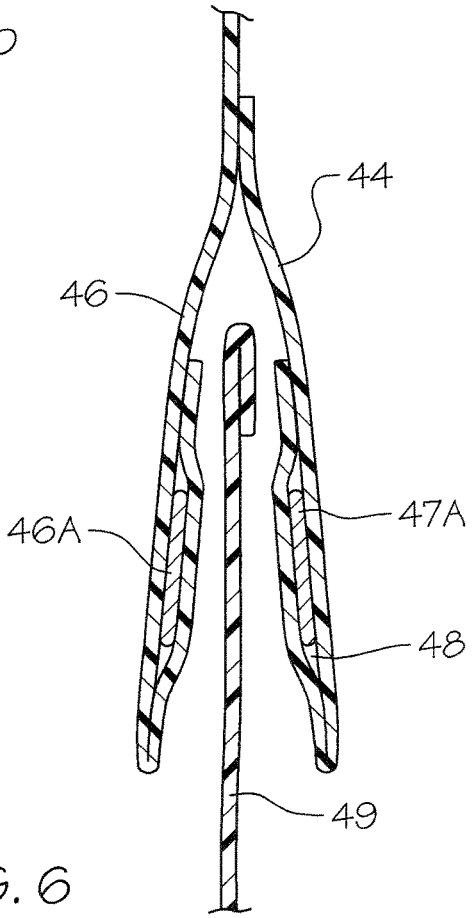
FIG. 6 is an enlarged partial cross-sectional view of the magnetic clamping engagement.
Figure 7:
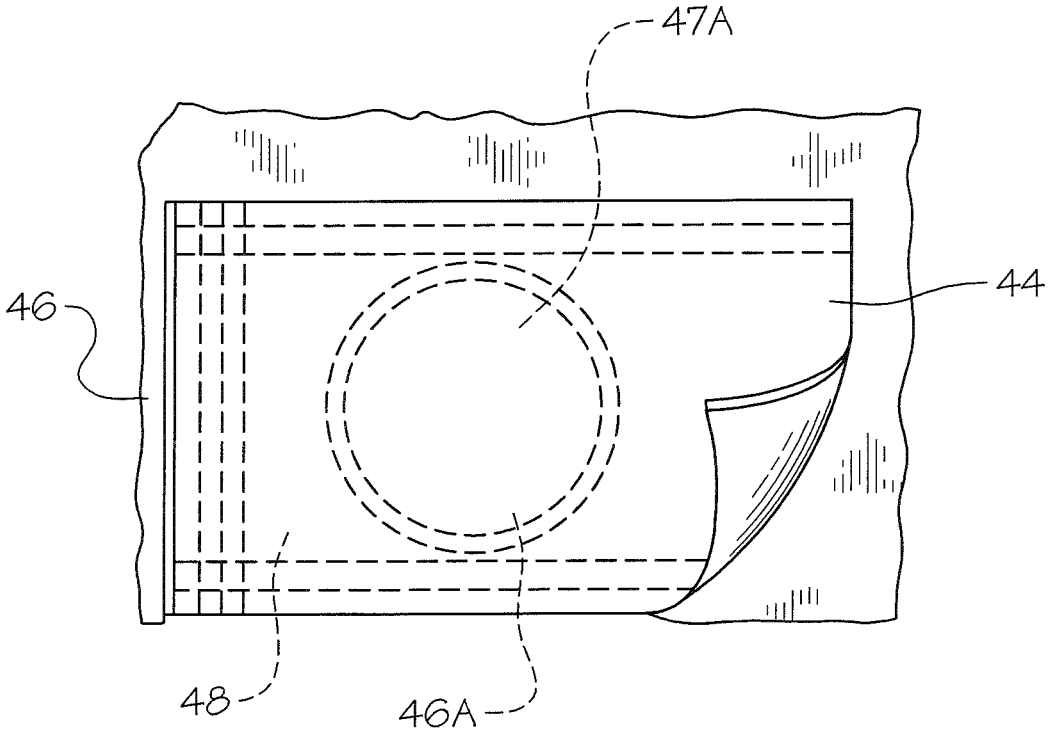
FIG. 7 is an enlarged partial front elevational view thereof.

A magnetic clamping system of the invention secures the upper and lower torso portions 11 and 12 together by the respective bottom edge 14 permanent magnets 21A,21B and 21C as noted with an aligned waistband magnets so as to "pin" themselves to the lower torso portion. This can be seen best in FIGS. 5-7 of the drawings where an alternate construction is illustrated showing an elongated clamping flap 44 which is secured inwardly along the bottom edge 45 of the torso portion. As noted, in the primary form, a number of permanent magnets 46A, 46B, 46C and 46D are secured along the main bottom end portion 46. Correspondingly, a plurality of longitudinally spaced "clamping" magnets 47A, 47B, 47C and 47D are secured within a longitudinally enclosed channel 48 of the flap 44 as best seen in FIGS. 6 and 7 of the drawings for selective clamping engagement on the lower torso upper edge portion 49 utilizing the magnetic attraction between the respective magnets in aligned orientation.

Figure 2:
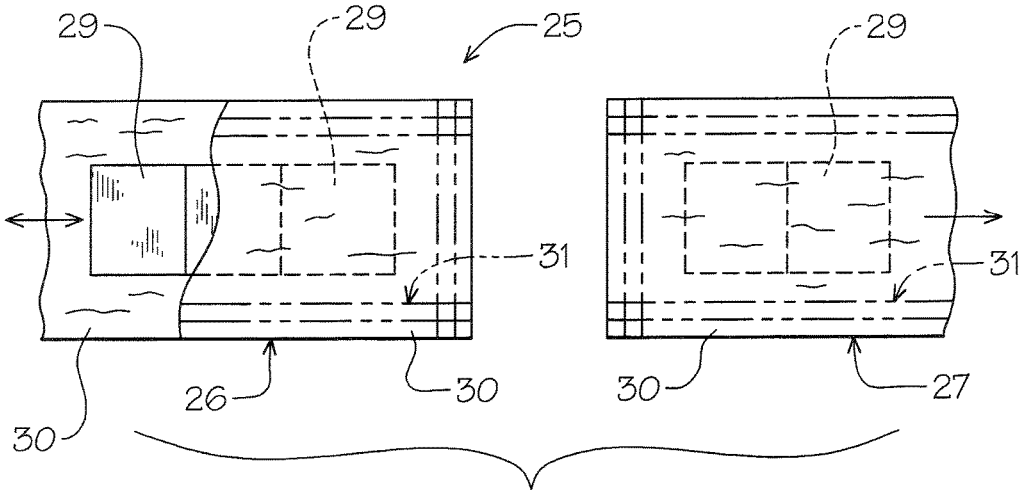
FIG. 2 is an enlarged partial front elevational view of the adjustable waistband and straps with magnets moveably positioned therein and on in an engagement overlapping position.
Figure 3:
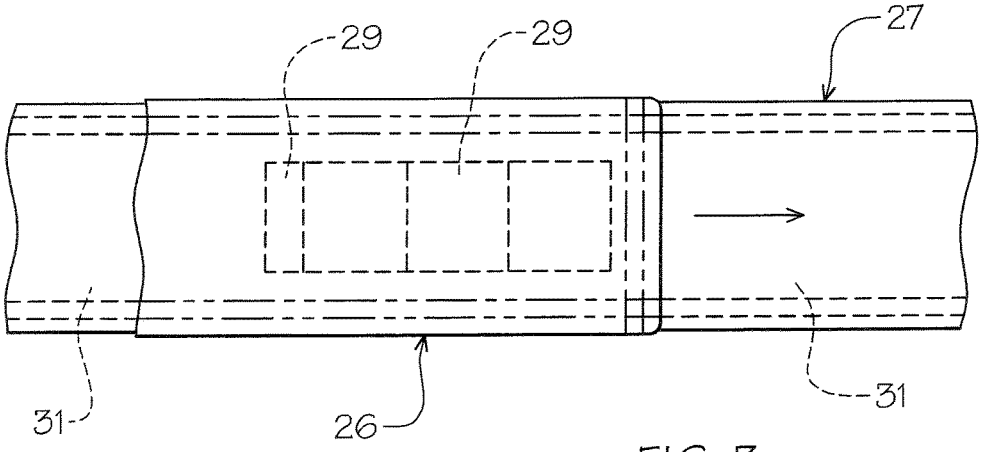
FIG. 3 is an enlarged partial front plan view thereof in adjustable engagement.

The lower torso portion 12 of the split lap form fitting apron assembly, which has a pair of joined leg covers 23 and 24 having respective adjustable magnetically enabled leg straps 23A and 24A extending midway therefrom, best seen in FIGS. 1-3 of the drawings.

A magnetically enabled adjustable inter-engagement waistband 25 and a correspondingly extending adjustable inter-engaging magnetically enabled waistband straps 26 and 27 extend from an upper edge 28 of the lower torso portion 12 providing adjustable retainment, as will be described in greater detail hereinafter.

It will be evident by the foregoing description that the adjustable interengageable waistband 25 on the lower torso portion 12 can be used independently of the attachable magnetic enabled upper torso portion 11 without being so attached. This provides alternate configuration availability in which the lower torso portion apron can be used, as noted, independently in a variety of different situations and requirements which may occur within the industry.

The waistband 25 magnetic attachment and fitting system of the invention comprises a plurality of permanent magnet sets 29 which are placed, by sewing, between multiple overlaying fabric bands 30 sewn together defining a channel 31 there within, allowing the magnetic sets 29 to be slidably positioned there within the respective channels 31.

The magnetically enabled waistband straps 26 and 27 can correspondingly be adjustably engaged and retained to one another by selectively overlapping longitudinal alignment to one another whereby the respective encapsulated magnetic sets 29 will attract and engage one another through the fabric 30 of the respective retaining straps 26 and 27, adjustably securing one to another.

Accordingly, the user will pull the respective straps 26 and 27 in opposite directions and the engaged magnetic sets 29 will hold them adjustably together at the chosen effective length.

It will be evident from the above description that during use, the straps 26 and 27 can therefore be selectively tightened (adjusted) as required by the user if displaced during use.

Figure 8:
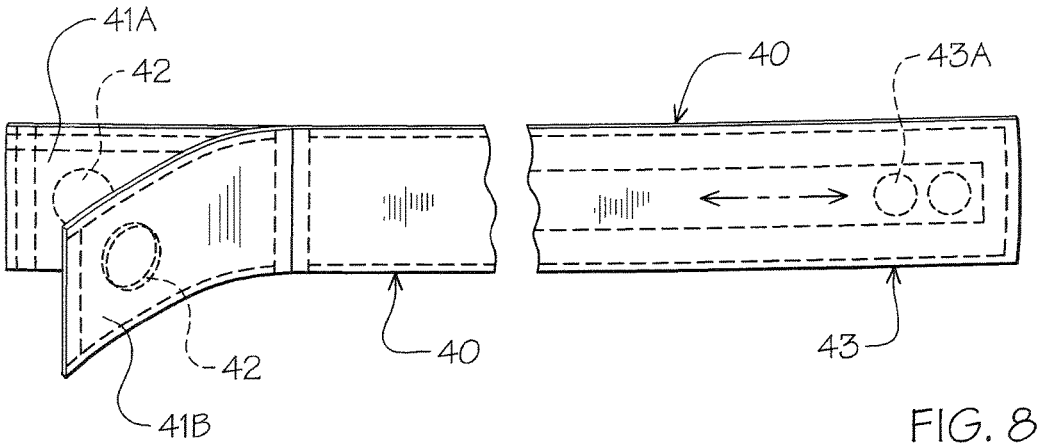
FIG. 8 is a front perspective view of an alternate clamping adjustable magnetic waist band.
Figure 9:
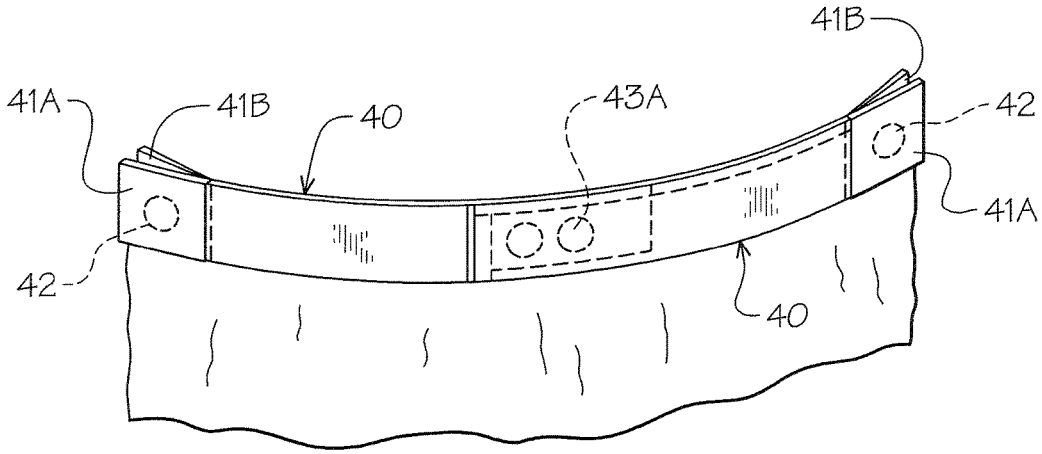
FIG. 9 is a partial front perspective view of the alternate waist band on an apron.

It will be apparent from the above description that the waist band 25 can also be independently formed from the primary point of attachment by using a pair of alternate two-part waist bands 40, best seen in FIGS. 8 and 9 of the drawings. The alternate waist band portions each have a bifurcated end 41A and 41B in which a magnet set 42 is positioned there within in corresponding aligned pockets.

The oppositely disposed end portions of the waist band 40 indicated at 43 have the same interengageable sliding permanent magnet sets 43A as seen in the primary form of the invention at 29 as described so as to be selectively engaged to one another at overlapping longitudinal alignment in directional orientation.

It will be evident from the above description that the bifurcated end portions with their so aligned magnets will effectively clamp onto any secondary garment G to provide auxiliary adjustable magnetic attachment waist bands as shown in the primary and alternate form of the invention to any existing non-configured apron configuration.

Figure 4:
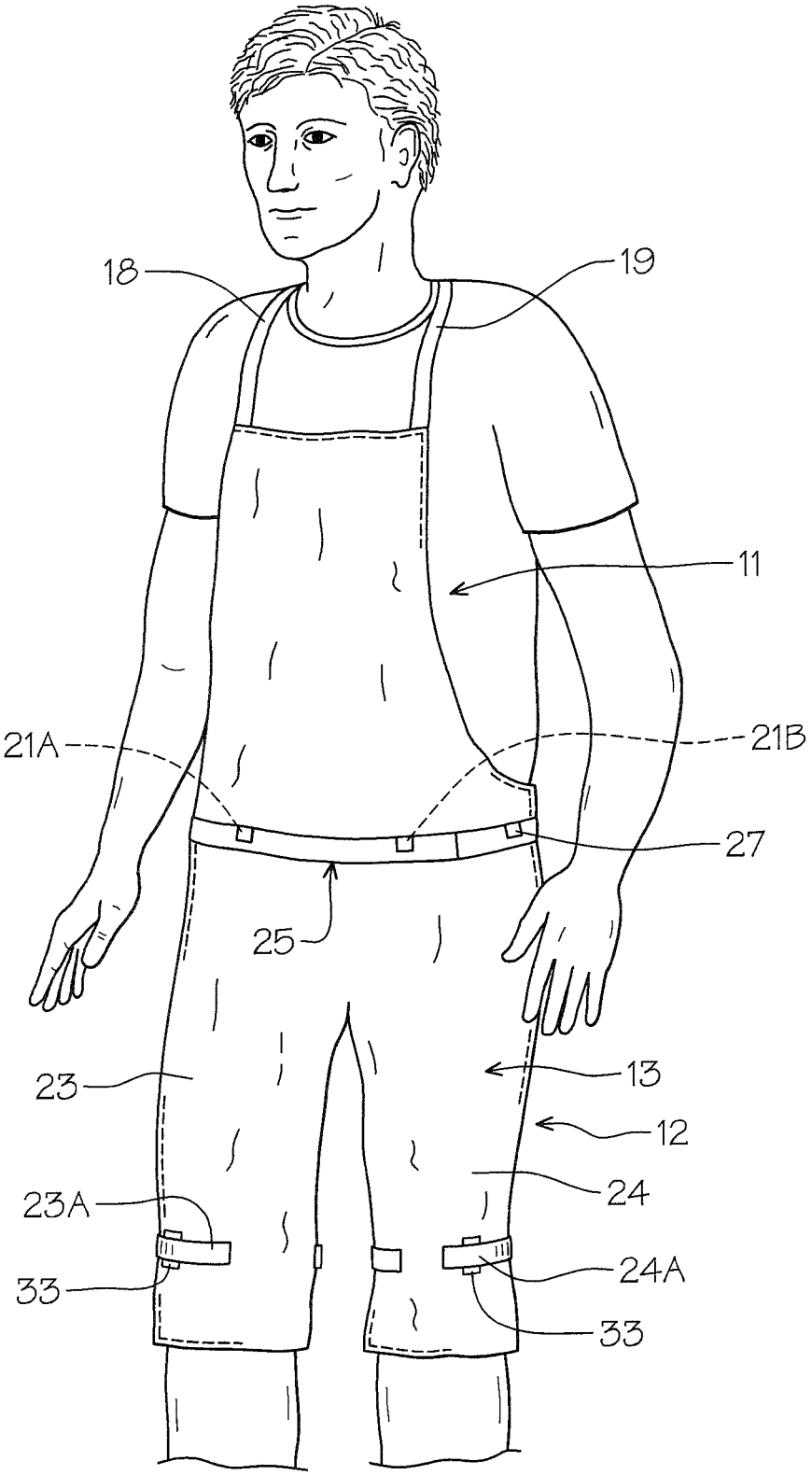
FIG. 4 is a graphic perspective view of the magnetically retained and adjustable two piece apron of the invention in use.

Referring now to FIGS. 1 and 4 of the drawings, the leg restraint straps 23A and 24A are provided with a set of stationary permanent magnets 31 on their respective anterior ends 32 and a stationary permanent magnet 33 on the body of the respective leg covers 23 and 24 in trans-lateral annular alignment with the leg straps 23A and 24A providing for adjustable selective inner-engagement therewith, as will be evident to those skilled in the art.

Figure 10:
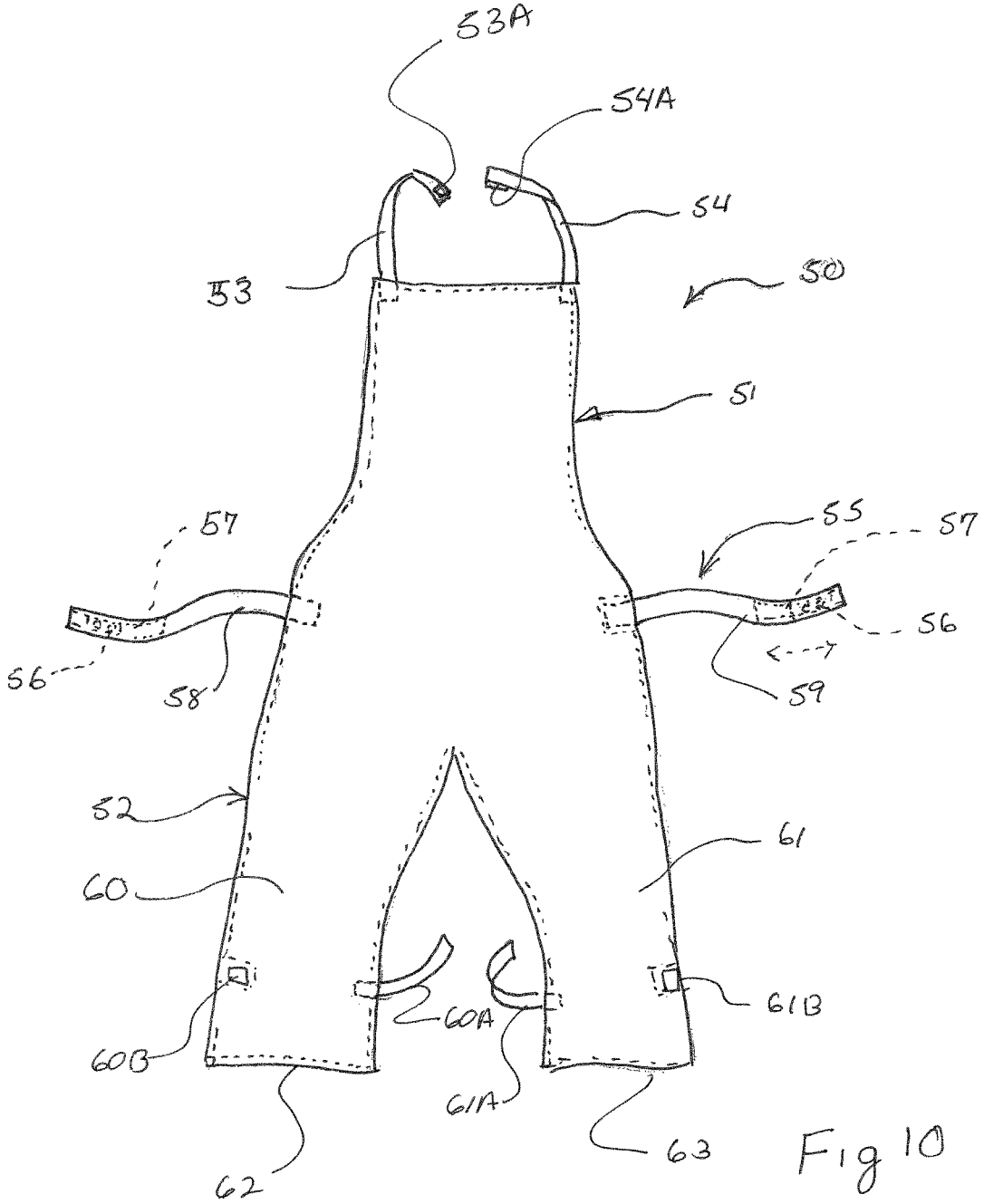
FIG. 10 is a front elevational view of an alternate one-piece embodiment.

It will be seen that FIG. 10 of the drawings illustrates a further embodiment of the invention wherein a one-piece apron 50 can be seen having an integral upper torso 51 and a lower torso 52 of similar configuration to that of the primary two-part magnetically secured apron assembly 10 hereinbefore described.

The integral one-piece apron 50 has a pair of neck engagement and retainment straps 53 and 54 with respective end attachment magnets 53A and 54A for adjustable registration with one another. A magnetically adjustable waistband assembly 55 extends about and from the transition area between the integral torso portions 51 and 52. The magnetically adjustable waistband 55 is of the same structural configuration as that of the primary waistband 25. A plurality of permanent magnet sets 56 are placed by sewing between correspondingly overlying fabric bands sewn together defining respective channels 57 within each of the free strap ends 58 and 59 which corresponds to the structure defined in the primary form of the magnetic adjustable waistband 25.

The straps ends 58 and 59 are correspondingly engaged by overlapping one another affording a selectively slidable adjustable waistband by the interengagement and selective movement of the magnetic sets 56 within the respective channels 57. The lower torso portion 52 of the integral one-piece magnetically adjustable apron 50 has joined leg covers 60 and 61 with respective adjustable magnetic enabled leg straps 60A and 61A extending therefrom inwardly of their respective free ends 62 and 63. The straps are correspondingly selectively and adjustably engaged on a pair of permanent magnets 60B and 61B secured on the leg covers in spaced transverse alignment therewith.

It will be noted that variety of apron material can be utilized, depending on the required use venue specific to applicable needs and usability in the environment so chosen.

It will thus be seen that a new and novel magnetically enabled adjustable and retainment apron assembly 10 has been illustrated and described, and it will be apparent to those skilled in the art that various changes and modifications may be made therein without departing from the spirit of the invention.

Therefore I claim:

1. A two-part body protection apron comprising,
- an upper torso portion and a lower torso portion,
- a pair of neck retainer straps extending from said upper torso portion,
- one or more magnets coupled directly to respective free ends of said straps,
- elongated parallel clamping flaps extending from a lower perimeter edge of said upper torso portion,
- a plurality of magnets in longitudinal aligned spaced relation to one another within said respective clamping flaps and in oppositely disposed aligned relation to one another between said flaps,
- adjustable magnetic waist bands on said lower torso portion, each having a bifurcated magnetic enabled free end positioned for magnetic attraction to one another over a garment there between,
- sliding magnet sets within respective waist band end pockets for magnetic attraction and overlapping adjustable end position,
- said apron's lower torso portion comprises,
- joined leg covers,
- magnetically enabled leg straps on each of said respective leg covers inwardly of respective leg cover's free ends.

2. The protection apron set forth in claim 1 further comprises,
- said waist bands having magnetically enabled free ends magnetically attached to one another at the waist band end pockets.

* * * * *